United States Patent [19]

Cornette et al.

[11] Patent Number: 4,703,872

[45] Date of Patent: Nov. 3, 1987

[54] DEVICE FOR DISPENSING LIQUID DETERGENTS IN WASHERS

[75] Inventors: Henri Cornette, Pontoise, France; Jørgen Heinø, Woluwe' St. Pierre, Belgium

[73] Assignee: The Procter & Gamble Company, Cincinnati, Ohio

[21] Appl. No.: 724,125

[22] Filed: Apr. 17, 1985

[30] Foreign Application Priority Data

Aug. 24, 1984 [FR] France ..... 84 13210

[51] Int. Cl.[4] ..... B67D 5/38

[52] U.S. Cl. ..... 222/158; 222/478; 68/171

[58] Field of Search ..... 239/34, 51, 53, 58–59; 4/223, 226–228, 231; 68/17 R; 222/158, 215, 463, 465 R, 478–480, 482–483, 489, 500, 519–520, 540, 565, 545

[56] References Cited

U.S. PATENT DOCUMENTS

| | | | |
|---|---|---|---|
| T993,001 | 4/1980 | McCarthy | 68/17 R |
| 1,497,960 | 6/1924 | Todaro | 222/519 |
| 2,086,631 | 7/1937 | Munro | 222/463 X |
| 2,330,774 | 9/1943 | Alexander | 222/520 |
| 2,550,572 | 4/1951 | Loomis | 222/519 X |
| 2,956,709 | 10/1960 | Nison et al. | 222/463 X |
| 3,108,722 | 10/1963 | Torongo et al. | 222/463 |
| 3,399,806 | 9/1968 | Lucas | 222/545 |
| 3,888,391 | 6/1975 | Merz | 222/52 |
| 4,014,105 | 3/1977 | Furgal et al. | 34/12 |
| 4,407,779 | 10/1983 | Thompson | 422/266 |
| 4,433,800 | 2/1984 | Owens | 222/547 |

FOREIGN PATENT DOCUMENTS

| | | | |
|---|---|---|---|
| 1086333 | 10/1967 | United Kingdom | 222/480 |

*Primary Examiner*—H. Grant Skaggs
*Assistant Examiner*—Michael S. Huppert
*Attorney, Agent, or Firm*—Richard C. Witte; John V. Gorman

[57] ABSTRACT

The device incorporates a body (41) and a cover-assembly (42). The latter has vents (47) and can be screwed onto the body (41). In use, with the cover (42) removed, the body (41) is filled through the opening (44) with liquid detergent up to the chosen level A or B. The cover (42) is then fixed and then the device is introduced into the drum of the machine where the linen is already present. During washing, the detergent is gradually distributed outwards by passing through the vents (47).

12 Claims, 10 Drawing Figures

DEVICE FOR DISPENSING LIQUID DETERGENTS IN WASHERS

TECHNICAL FIELD

The present invention relates to the field of washing fabrics in washing machines with liquid detergents and, more particularly, to a device, in general reloadable, which is first filled with liquid detergent, and then placed in the drum of the machine with the fabrics to be washed. The detergent held in the device is distributed gradually into the washing medium and into the fabrics present in the machine.

BACKGROUND OF THE INVENTION

The applicant has found that when a liquid detergent product is placed in built-in dispensers of many washing machines, a portion of the product is carried away with the first quantity of the water introduced into the machine, proceeding to the sump and drain lines of the machine. Such portion will remain unutilized and will be discarded fromthe washer with the first operation. This is wasteful of the product and the resulting expense could create an unfavorable reaction on the part of the user respecting liquid detergents. It is therefore desirable to provide a device which will obviate the waste and provide for progressive release of liquid detergent in the wash water.

SUMMARY OF THE INVENTION

The present invention relates to a device for washing fabrics in a machine with a liquid detergent, the said device incorporating at least one filling orifice and vents for gradual release of the liquid within the fabrics which are being washed, the said device being characterized in that it is of a substantially spherical shape.

The invention also relat3es to the following characteristics, considered in isolation or in accordance with all their technically possible combinations:

the device has a flattening enabling it to remain in a stable position on a horizontal surface;

the flattening is diametrically opposite the filling orifice;

the device has a substantially spherical body equipped with an opening and an added assembly, the said assembly covering the said opening and being intended for filling with and/or distributing the liquid;

the body and the assembly form a practically continuous spherical outer surface, the device thus having the general appearance of a ball;

the assembly is mounted on the body in a removable manner, for example in the form of a quick mounting by rotation or by pressure;

the assembly is mounted on the body permanently;

the assembly incorporates a plurality of vents distributed circumferentially in a uniform manner;

the assembly is removable and incorporates no orifices apart from the distribution vents;

the assembly is mounted permanently and incorporates at least one central filling orifice and vents distributed at its periphery;

the filling orifice has the shape of a funnel entering inside the body;

the end face of the funnel, situated inside the body, is closed by a wall and the funnel has holes used for filling;

the assembly incorporates grasping means facilitating access to the grasping means;

the spherical body is interrupted by a crown-shaped planar surface surrounding its opening concentrically;

the body is made of a material which permits the user to see the level of liquid present in the body during filling;

the body has external markings corresponding to various liquid levels.

An essential characteristic of the present invention lies in the general spherical shape of the device. The latter thus has the appearance of a ball. Such a ball is extremely easy to handle and to place in the drum of the washing machine. After having introduced the fabrics into the latter, it is sufficient to place the ball on the fabrics. During operating, the liquid detergent held in the ball is gradually and uniformly spread in the washing medium. At the end of the washing cycle the ball is perfectly clean and free from both water and liquid detergent. In effect, no retention of liquid is found. Without wishing to be bound by any theory, it is through that this advantageous effect is due to the fact that as the drum rotates the centrifugal force acting on the moving ball results in removal of any liquid which may be present in the latter.

The invention will be further illustrated in the following description, with the aid of concrete examples of embodiment. It goes without saying, however, that the invention is not restricted in any way to such exemplary devices. Thus, the diameter and the number of vents depend solely on the viscosity of the liquid detergent.

Surprisingly, it has been found that the use of a device according to the invention afforded a marked improvement in performance during the washing of fabrics in a machine. This improvement is very clearly noted in machines having physical systems resulting in detergent losses. The improvement is still appreciable in many cases in machines which do not incorporate such physical loss systems, for example a program system or other, and this is by virtue of the fact that the ball which is placed within the fabrics provides a measured and gradual delivery of the liquid in the fabric, which is found to be generally favorable for washing efficiency.

DETAILED DESCRIPTION OF THE INVENTION

Figure 1:
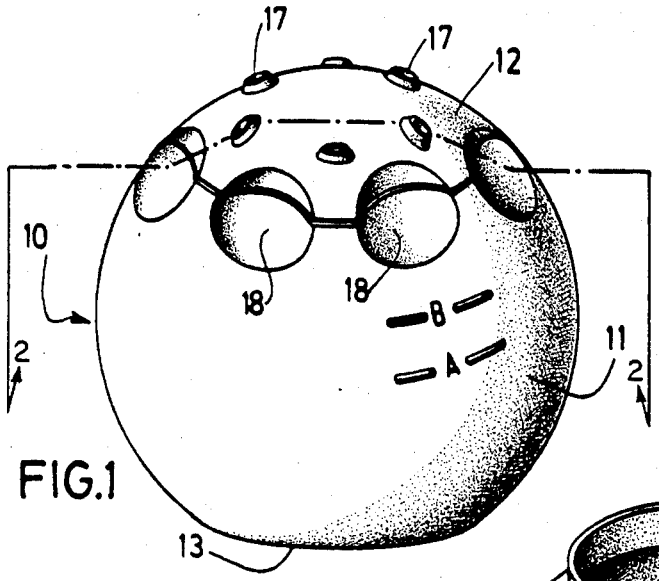
FIG. 1 is a device according to the invention, seen in perspective.
Figure 3:
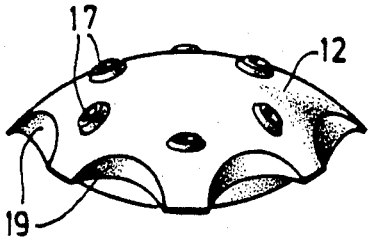
FIG. 3 shows in perspective the added assembly of the device of FIGS. 1 and 2.

The device shown in FIGS. 1 to 4 is indicated by the general reference 10. It is substantially spherical in shape and consists of a body 11 and an added assembly or cover 12. In this embodiment, the assembly 12 acts as a cover which can be fixed in a removable manner on the body 11. The device has the general appearance of a ball.

In its bottom end the body 11 incorporates a flattening 13 which enables it to be set in a stable manner on a horizontal surface. In a zone which is diametrically opposite this flattening 13, the body 11 incorporates an orifice 14 for filling with liquid detergent. The walls defining the orifice 14 are equipped with ramps 15 permitting the assembly or cover 12 to be easily fitted. In this embodiment, the mounting is of the rotary type known under the name "twist-off". It goes without saying that any other quick mounting of the cover 12 on the body 11 could be adopted, for example a coupling by a rim and corresponding groove, to permit pressure fitting of the cover on the body and, conversely, a separation of these two components by a pull on the cover 12.

Figure 2:
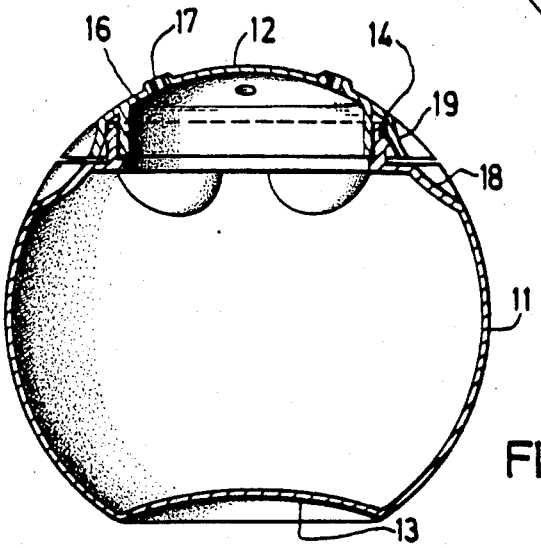
FIG. 2 is a diametral section along line II—II of FIG. 1.

In the embodiment in FIGS. 1 to 4, it is important to emphasise that the cover-assembly 12 is removed during filling with liquid and functions essentially to distribute the liquid, by virtue of the fact that it has vents 17. In the exemplary embodiment these vents are six in number. To ensure uniform delivery of the liquid, the vents are distributed symmetrically at the periphery of the cover 12. Furthermore, the latter incorporates means capable of cooprating with the ramp 15. These means 16 are shown in FIG. 2 and ae known to the expert in this type of assembly by quick rotation.

The cover 12 is also equipped with means 19 which permit easy manipulation. These means 19 consist of a number of uniformly spaced hollows on the outer periphery of the cover. There are corresponding hollows 18 on the body 11 which permit still easier access to the hollows 19 of the cover 12. In effect, the user can grasp the cover with the fingertips of only one hand, whatever the position of the latter relative to the device.

Figure 4:
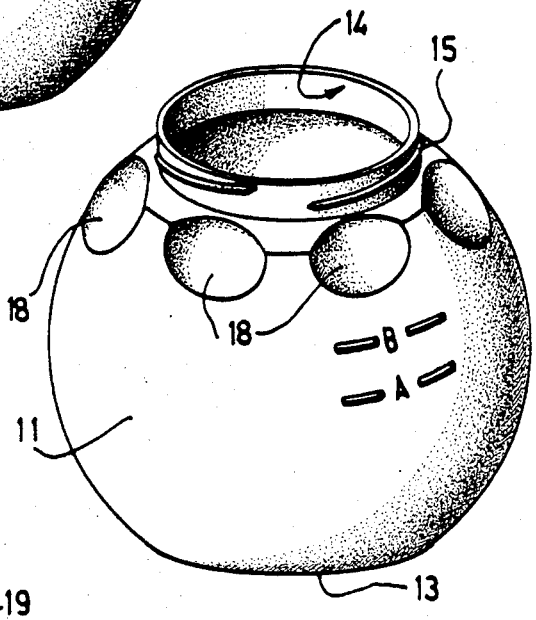
FIG. 4 is a perspective view showing the body of the device in the embodiment of FIGS. 1, 2 and 3. .

Also shown in the drawings of FIGS. 1 and 4 are markings indicated by the letters A, B and corresponding to various predetermined liquid levels, with a view to the filling of the device.

The use of the device just described is as follows. With the cover 12 removed, the body 11 is first filled with liquid detergent up to the required level. Once the filling operation has been completed, the cover 12 is fixed onto the body 11. Furtermore, the fabrics have been arranged in the drum of the washing machine. The ball 10, filled with liquid detergent, is then introduced into or onto the fabrics present in the drum. Once the machine has been started, the liquid held in the ball 10 is uniformly and gradually distributed through the vents 17 in the cover 12. A highly satisfactory washing and cleaning of the fabrics is thus ensured.

Figure 5:
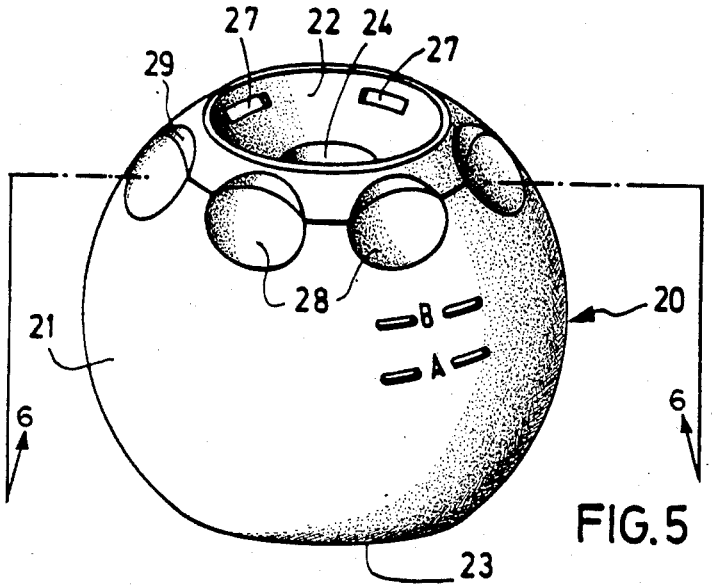
FIG. 5 shows an alternative form of embodiment in perspective.
Figure 6:
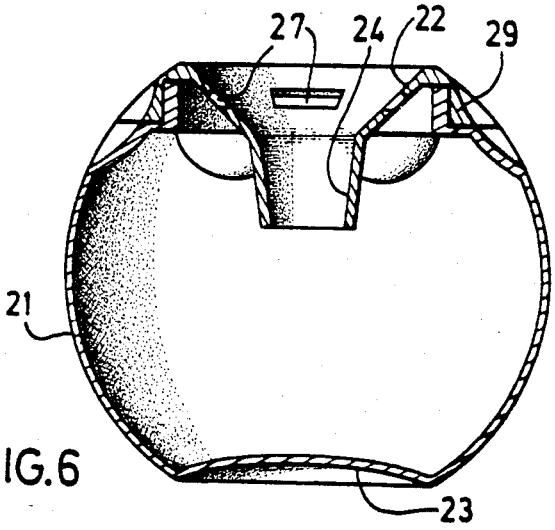
FIG. 6 is a diametral section taken along the line VI 13 VI of the device of FIG. 5.

In the alternative form of embodiment shown in FIGS. 5 and 6, the device according to the invention, which is indicated by the general reference 20, is still generally in the shape of a sphere or ball. It consists of a body 21 and an added assembly 22. However, in contrast to the embodiment of FIGS. 1 to 4, the assembly 22 is permanently fixed on the body 21, by any suitable means, for example by glueing or welding. In this case, the assembly 22 acts as means for both filling with and distributing the liquid detergent. For this purpose it has, on the one hand, a central opening 24 in the shape of a funnel entering inside the body 21 and, on the other hand, peripheral vents 27. In the example chosen, the vents are four in number. The opening 24 is used essentially for filling and the vents 27 permit gradual release of the liquid detergent during washing.

The drawings of FIG. 5 and 6 also show hollows 28 and 29 respectively on the body 21 and on the assembly 22. In fact, such an arrangement is not essential in any way when the user does not have to manipulate the assembly 22.

In another alternative form, however, it is quite possible to provide an assembly 22, such as is shown in FIGS. 5 and 6, in a removable mounting, be it by rotation or by pressure, as illustrated in FIGS. 1 to 4.

Figure 7:
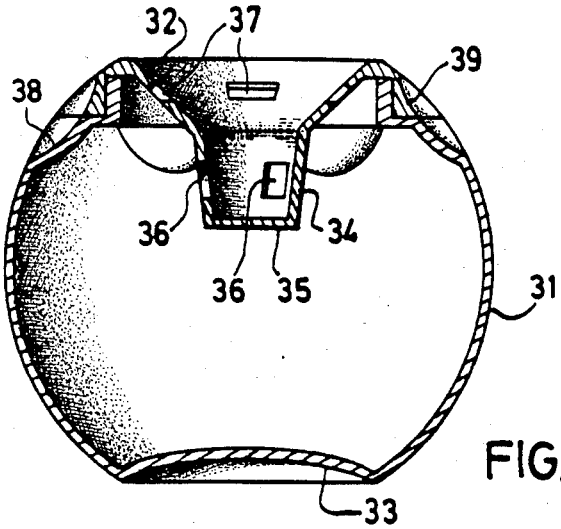
FIG. 7 is a cross-section similar to that of FIG. 6, showing another embodiment.

The alternative form of embodiment shown in FIG. 7, which is a cross-section similar to FIG. 6, incorporates a body 31 and an added assembly 32. The latter is permanently fixed on the body 31. The construction of FIG. 7 is very similar to that of FIG. 6, except where the construction of the assembly 32 is concerned. The latter has a central opening 34 in the form of a funnel entering inside the body 31 and terminating in an end wall 35. The assembly 32 incorporates orifices 36 which, in the example shown, are three in number and which are provided in the walls of the funnel 34 which terminate in the end wall 35. The orifices 36 are used for filling with liquid detergent. Furthermore, the assembly 32 incorporates, like assembly 22 of FIG. 6, a certain number of vents 37 permitting gradual release of the liquid detergent during washing. Also shown in FIG. 7 is the flattening 33 of the body 31, together with the hollows 38 and 39, although the presence of such hollows is not absolutely necessary.

Figure 8:
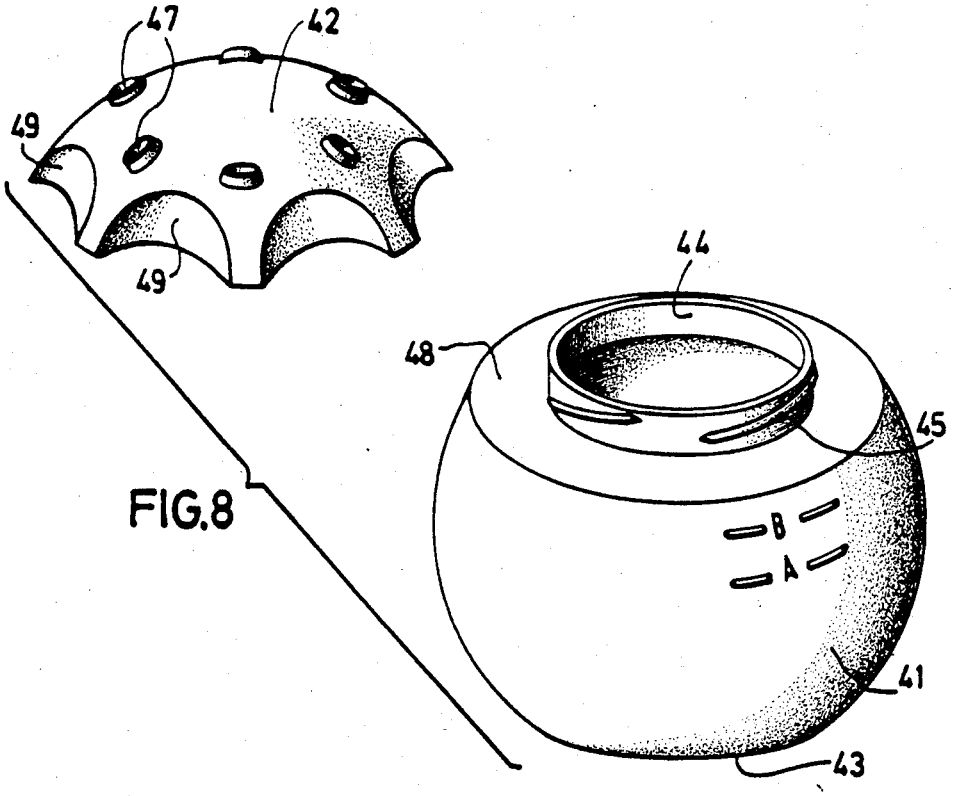
FIG. 8 illustrates in perspective another alternative form of embodiment with the body and the corresponding cover-assembly, these two parts being shown separately.

FIG. 8 illustrates in perspective another alternative form of embodiment showing a cover-assembly 42 and a body 41 permitting removable fixing of the cover 42. The novelty of this alternative form lies in the shape of the body 41. Effectively, the latter, which is generally spherical in shape, is interrupted by a crown-shaped planar surface 48, surrounding the opening 44 concentrically. The Figure also shows the flattening 43 of the body 41 as well as the means 45 which, in the example chosen, permit fixing, by quick screwing, of the cover-assembly 42. The latter is equipped with corresponding means which are not shown in the drawing. As in the other embodiments, the device of FIG. 8 incorporates, on the cover assembly 42 fitted on the body 41, vents 47 for delivering liquid detergent during washing. Hollows 49 form means for grasping the cover-assembly 42.

Figure 9:
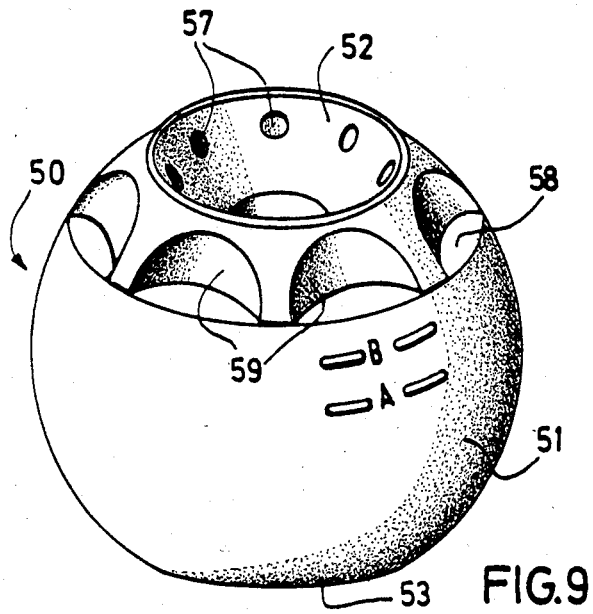
FIG. 9 is a perspective view of yet another alternative form.
Figure 10:
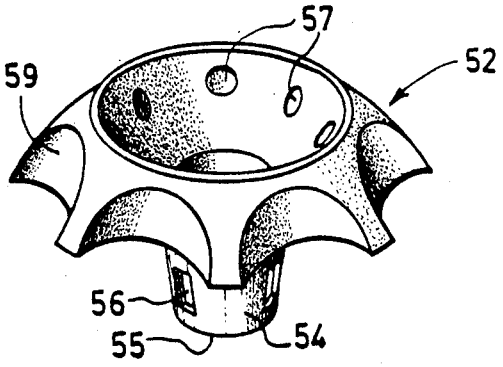
FIG. 10 shows in perspective the cover-assembly corresponding to the alternative form of FIG. 9.

Another alternative form of embodiment is shown in FIG. 9, the corresponding cover-assembly of which is shown in FIG. 10. The device of FIG. 9, which is denoted by the general reference 50, incorporates a body 51 and a cover-assembly 52 to form a device of a generally spherical shape. The body 51 is similar to the body 41 of FIG. 8, and thus has a planar surface 58 surrounding the opening 54 concentrically. In the alternative form illustrated in the drawings, the cover-assembly 52 is permanently fixed on the body 51. This cover-assembly is shown in greater detail in FIG. 10, from which it can be seen that it incorporates, as in the embodiment illustrated in FIG. 7, a central opening 54 in the shape of a funnel entering inside the body 51. This funnel terminates in an end wall 55. The side surface of the funnel 54 incorporates orifices 56 intended to permit filling with the liquid detergent. Furthermore, the cover-assembly 52 incorporates a certain number of vents 57 arranged uniformly on the part opposite the wall 55. Lastly, the cover-assembly 52 incorporates hollows 59 permitting easier grasping of the whole device, which can thus be easily handled.

As mentioned earlier, the expert can add to the embodiments described above by way of examples all kinds of modifications which do not depart from the scope of the present invention.

As an example, and whatever the form of embodiment in the Figures illustrated earlier, the ball may be avilable for use after it has been pre-filled with liquid detergent. This form of presentation can, in particular, conssit of a test quantity. In this case, it is appropriate to provide a system of blocking the vents which are intended, in use, to delivery liquid detergent during washing. This blocking system may consist of capping with a film which can be torn off, or with quick tear-off means which uncover the vents. A possible embodiment then consists in providing nipples of a kind which are respectively engaged in the vents and which can be removed at the same time or separately, with one or more tear strips. These are different forms of presentation which nevertheless result in one and the same type of device which, in accordance with the invention, may be employed in a process of washing and cleaning fabrics in a machine, in which process, once the device has been placed in the drum of the machine with the fabrics to be washed, the detergent held in the device is gradually distributed in the washing medium and in the fabrics which it contains.

We claim:

1. Device for dispensing liquid detergent for washing fabrics in a washing machine, the said device incorporating at least one filling orifice and a plurality of vents which are adapted for gradual release of the liquid within the fabrics during washing, the said device being characterized in that it is of a substantially spherical shape, has a flattening enabling it to remain in a stable position on a horizontal surface, said filling orifice and vents being formed in an inwardly extending funnel-shaped reentrant wall diametrically opposite the flattening, with the vents spaced around and adjacent to the outer periphery of the reentrant wall and the filling orifice located in the inner section thereof, and that said device contains a measured quantity of said liquid detergent.

2. Device according to claim 1 characterized in that it has a body which is substantially spherical equipped with an opening and an added assembly, the said assembly covering the said opening and having said wall formed therein.

3. Device according to claim 2, characterized in that the body and the assembly form a generally continuous spherical outer surface, the device thus having the general appearance of a ball.

4. Device according to claim 2, characterized in that the assembly is mounted in a removable manner on the body.

5. Device according to claim 2, characterized in that the assembly is mounted on the body permanently.

6. Device according to claim 2, characterized in that the vents are spaced uniformly about said periphery.

7. Device according to claim 1, characterized in that the filling orifice is centrally located at the distal end of the inner section of said wall.

8. Device according to claim 2, characterized in that the distal end of the inner section of said wall, situated inside the body, is closed and in that the filling orifice extends through the sidewall of said inner section of said wall.

9. Device according to claim 2, characterized in that the assembly incorporates grasping means.

10. Device according to claim 9, characterized in that the body has hollows facilitating access ot the grasping means.

11. Device according to claim 2, characterized in that the body is made of a material permitting the user to see the level of liquid held in the body during filling.

12. Device according to claim 2, characterized in that the body has external markings corresponding to various liquid levels.

* * * * *

UNITED STATES PATENT OFFICE

CERTIFICATE OF CORRECTION

PATENT NO. : 4,703,872

DATED : November 3, 1987

INVENTOR(S) : Henri Cornette and Jorgen Heino

It is certified that error appears in the above-identified patent and that said Letters Patent is hereby corrected as shown below:

Column 1, line 22, "fromthe" should read -- from the --.

Column 1, line 38, "relat3es" should read -- relates --.

Column 2, line 21, "through" should read -- thought --.

Column 2, line 58, "VI 13 VI" should read --VI-VI --.

Column 3, Line 34, "cooprating" should read -- cooperating --.

Column 3, line 35, "ae" should read -- are --.

Column 3, line 53, "Furtermore" should read -- Furthermore --.

Column 5, line 15, "conssit" should read -- consist --.

Column 6, claim 7, line 1, "claim 1" should read -- claim 2 --.

Column 6, claim 10, line 2, "ot" should read -- to --.

Signed and Sealed this

Twentieth Day of March, 1990

*Attest:*

JEFFREY M. SAMUELS

*Attesting Officer*

*Acting Commissioner of Patents and Trademarks*